US009174179B2

(12) United States Patent
Bertucci et al.

(10) Patent No.: US 9,174,179 B2
(45) Date of Patent: Nov. 3, 2015

(54) MULTI-STATION LIQUID DISPENSING APPARATUS WITH AUTOMATIC SELECTION OF PROPER FLOW RATE

(71) Applicant: Diversey, Inc., Sturtevant, WI (US)

(72) Inventors: Michael H. Bertucci, Gurnee, IL (US); Curtis H. Hubmann, Racine, WI (US); Christopher F. Lang, Racine, WI (US); Steven E. Schiller, Kenosha, WI (US)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 14/083,810

(22) Filed: Nov. 19, 2013

(65) Prior Publication Data

US 2014/0138403 A1 May 22, 2014

Related U.S. Application Data

(63) Continuation of application No. 13/164,260, filed on Jun. 20, 2011, now Pat. No. 8,584,716, which is a continuation of application No. 12/397,110, filed on Mar. 3, 2009, now Pat. No. 7,963,304, which is a continuation of application No. 11/203,315, filed on Aug. 12, 2005, now Pat. No. 7,516,763.

(60) Provisional application No. 60/707,399, filed on Aug. 11, 2005.

(51) Int. Cl.

| | |
|---|---|
| ***B65B 1/04*** | (2006.01) |
| ***B01F 5/04*** | (2006.01) |
| ***B01F 3/08*** | (2006.01) |

(Continued)

(52) U.S. Cl.

CPC ..... *B01F 5/0413* (2013.01); *B01F 3/088* (2013.01); *B01F 3/0865* (2013.01); *B01F 5/043* (2013.01); *B01F 13/1055* (2013.01); *B67D 7/02* (2013.01); *B01F 2003/0896* (2013.01); *Y10T 137/87684* (2015.04)

(58) Field of Classification Search

USPC ..... 141/360, 18, 9, 100, 104; 222/144.5, 222/331, 132, 129.2, 145.1, 481; 239/304, 239/305, 310, 318, 74

See application file for complete search history.

(56) References Cited

U.S. PATENT DOCUMENTS

| | | | |
|---|---|---|---|
| D118,448 | S | 1/1940 | Helms |
| 2,881,802 | A | 4/1959 | Crawford |

(Continued)

FOREIGN PATENT DOCUMENTS

| | | |
|---|---|---|
| DE | 19736982 | 8/1998 |
| EP | 0068906 | 1/1983 |

(Continued)

OTHER PUBLICATIONS

Four panel brochure entitled "Innovative Dilution Control Systems" dated 2000, showing the Dispensing Unit and the Quattro Solutions Center.

*Primary Examiner* — Jason K Niesz

(74) *Attorney, Agent, or Firm* — Michael Best & Friedrich LLP

(57) ABSTRACT

A multi-station liquid mixing and dispensing apparatus. The apparatus includes a housing that defines a first pocket for supporting a first container, a second pocket for supporting a second container, and a third pocket disposed vertically above at least one of the first pocket and the second pocket. The apparatus also includes a first door pivotably coupled to the housing and enclosing the first pocket, and a second door pivotably coupled to the housing and enclosing the second pocket. The apparatus also includes a valve coupled to the housing to control flow of chemical concentrate to at least one of the first container and the second container.

20 Claims, 7 Drawing Sheets

(51) Int. Cl.
*B01F 13/10* (2006.01)
*B67D 7/02* (2010.01)

(56) References Cited

U.S. PATENT DOCUMENTS

| | | | | |
|---|---|---|---|---|
| 3,618,637 | A | | 11/1971 | Santomieri |
| 3,651,991 | A | | 3/1972 | Ohlson et al. |
| D235,388 | S | | 6/1975 | Taylor |
| 3,976,227 | A | * | 8/1976 | Ray ..... 222/136 |
| 4,356,937 | A | * | 11/1982 | Simon et al. ..... 222/129.2 |
| 5,033,649 | A | | 7/1991 | Copeland et al. |
| 5,129,434 | A | | 7/1992 | Whigham et al. |
| 5,159,958 | A | | 11/1992 | Sand |
| 5,253,677 | A | | 10/1993 | Sand |
| 5,259,557 | A | | 11/1993 | Spriggs et al. |
| 5,344,074 | A | | 9/1994 | Spriggs et al. |
| 5,351,875 | A | * | 10/1994 | Rhine et al. ..... 222/132 |
| 5,377,718 | A | | 1/1995 | Sand |
| 5,400,839 | A | | 3/1995 | Cravett |
| 5,452,825 | A | * | 9/1995 | Comstock et al. ..... 222/135 |
| D367,659 | S | | 3/1996 | Baker et al. |
| 5,522,419 | A | | 6/1996 | Sand |
| 5,570,816 | A | | 11/1996 | LaBarbera, Jr. |
| 5,584,327 | A | | 12/1996 | Thomas et al. |
| 5,653,261 | A | | 8/1997 | Dalhart et al. |
| D385,746 | S | | 11/1997 | Fritz |
| 5,799,831 | A | | 9/1998 | Spriggs et al. |
| 5,832,972 | A | | 11/1998 | Thomas et al. |
| 5,862,829 | A | | 1/1999 | Sand |
| D407,092 | S | | 3/1999 | Weaver |
| D408,207 | S | | 4/1999 | Bourke |
| 5,902,041 | A | | 5/1999 | Parsons et al. |
| 5,927,338 | A | | 7/1999 | Boticki et al. |
| 5,957,152 | A | | 9/1999 | Dalhart |
| 6,095,372 | A | | 8/2000 | Dorsey et al. |
| 6,238,081 | B1 | | 5/2001 | Sand |
| 6,279,598 | B1 | | 8/2001 | Boticki et al. |
| 6,299,035 | B1 | | 10/2001 | Dalhart |
| 6,322,242 | B1 | | 11/2001 | Lang et al. |
| 6,363,977 | B1 | * | 4/2002 | Smeller et al. ..... 141/18 |
| 6,412,527 | B1 | | 7/2002 | Brice |
| 6,439,272 | B1 | | 8/2002 | Wertheim |
| 6,499,872 | B2 | | 12/2002 | Sand |
| 6,588,466 | B1 | | 7/2003 | Lohr |
| 6,619,318 | B2 | | 9/2003 | Dalhart et al. |
| 6,634,376 | B2 | | 10/2003 | Haas |
| 6,655,401 | B2 | | 12/2003 | Sand et al. |
| 6,763,860 | B2 | * | 7/2004 | Jungmann et al. ..... 141/104 |
| 6,789,708 | B2 | | 9/2004 | Hansen |
| D498,637 | S | | 11/2004 | Heilstedt et al. |
| D499,599 | S | | 12/2004 | Morrison |
| 7,004,355 | B1 | * | 2/2006 | Crisp et al. ..... 222/129.4 |
| D523,878 | S | | 6/2006 | Quinlan et al. |
| D544,287 | S | | 6/2007 | Joss et al. |
| D555,287 | S | | 11/2007 | Long et al. |
| D555,413 | S | | 11/2007 | Lin |
| D555,415 | S | | 11/2007 | Lin |
| D571,598 | S | | 6/2008 | Moore |
| D589,738 | S | | 4/2009 | Michler |
| D589,988 | S | | 4/2009 | Martin et al. |
| 7,516,763 | B2 | | 4/2009 | Bertucci et al. |
| D608,129 | S | | 1/2010 | Spear et al. |
| D619,151 | S | | 7/2010 | Tsuji |
| D620,302 | S | | 7/2010 | Picozza et al. |
| 7,963,304 | B2 | | 6/2011 | Bertucci et al. |
| D652,674 | S | | 1/2012 | Bertucci et al. |
| D666,868 | S | | 9/2012 | Bertucci et al. |
| 8,584,716 | B2 | | 11/2013 | Bertucci et al. |
| 2001/0042759 | A1 | * | 11/2001 | Dion ..... 222/108 |
| 2003/0056841 | A1 | | 3/2003 | Dalhart et al. |
| 2004/0065673 | A1 | | 4/2004 | Hansen |
| 2004/0094226 | A1 | | 5/2004 | Wertheim |
| 2004/0163720 | A1 | | 8/2004 | Joung |
| 2005/0150572 | A1 | | 7/2005 | Beldham et al. |
| 2006/0174778 | A1 | | 8/2006 | Greiwe |
| 2006/0174779 | A1 | | 8/2006 | Ng |
| 2007/0028980 | A1 | | 2/2007 | Lohr et al. |
| 2010/0024915 | A1 | * | 2/2010 | Thomas et al. ..... 141/69 |
| 2010/0276452 | A1 | * | 11/2010 | Vesborg et al. ..... 222/144.5 |

FOREIGN PATENT DOCUMENTS

| | | |
|---|---|---|
| FR | 2130157 | 11/1972 |
| WO | 91/14647 | 10/1991 |
| WO | 02/22444 | 3/2002 |
| WO | 02/40178 | 5/2002 |
| WO | 02/070397 | 9/2002 |
| WO | 2004/031634 | 4/2004 |
| WO | 2007/021561 | 2/2007 |

* cited by examiner

MULTI-STATION LIQUID DISPENSING APPARATUS WITH AUTOMATIC SELECTION OF PROPER FLOW RATE

CROSS-REFERENCE TO RELATED APPLICATIONS

This application is a continuation of U.S. patent application Ser. No. 13/164,260, filed Jun. 20, 2011, which is now U.S. Pat. No. 8,584,716, issued on Nov. 19, 2013; which is a continuation of U.S. patent application Ser. No. 12/397,110, filed Mar. 3, 2009, which is now U.S. Pat. No. 7,963,304, issued on Jun. 21, 2011; which is a continuation of U.S. patent application Ser. No. 11/203,315, filed Aug. 12, 2005, which is now U.S. Pat. No. 7,516,763, issued on Apr. 14, 2009; which claims priority to U.S. Provisional Patent Application No. 60/707,399, filed on Aug. 11, 2005, the entire contents of each of which is incorporated herein by reference.

BACKGROUND OF THE INVENTION

This invention relates generally to liquid handling and more particularly, to combining and dispensing multiple liquids in a manner that the usage is simplified and maintenance is substantially reduced.

In the maintenance of large buildings such as office buildings or stores in shopping centers, it is customary to mix the required cleaning agents from a source of concentrate with water. The resulting solutions are then filled into suitable containers such as bottles or buckets. Apparatuses of this type are available from JohnsonDiversey, Inc. of Sturtevant, Wis., as the Quattro SS Solutions Center, J-Fill Select and Taski Ultra Easy.

While the previously described units afford accurate, reliable and safe dispensing of solutions, their operating could be simplified as well as their maintenance. For example, these apparatuses require the hand movement of one knob or button for selection of concentrates and the movement of a valve or another button for flow of water.

It would simplify the operation of these types of apparatuses if only a single selector knob had to be manipulated and a valve could be activated by a container or a trigger.

The objects of the invention therefore are:

a. Providing an improved liquid mixing and dispensing apparatus.

b. Providing a liquid mixing and dispensing apparatus which allows for easier filling of containers.

c. Providing a liquid mixing and dispensing apparatus of the foregoing type which reduces labor costs to repair.

d. Providing a liquid mixing and dispensing apparatus of the foregoing type which minimizes training.

e. Providing a liquid mixing and dispensing apparatus of the foregoing type which improves work productivity.

SUMMARY OF THE INVENTION

The foregoing objects are accomplished and the shortcomings of the prior art are overcome by the multi-station liquid mixing and dispensing apparatus of the invention which includes a support member with a plurality of containers placed on the support member. There are first and second valve members with one of the first and second valve members being container activated. A liquid intake manifold is connected to the first and second valve members. There are first and second eductors, one of the eductors having a flow rate slower than the other with the first and second valve members connected to the first and second eductors. A multi-port valve member is connected to the first and second eductors. A liquid product supply line is operatively connected to each container and to the multi-port valve member. Liquid outlet lines are connected to the first and second eductors. The first and second valve members and the first and second eductors are constructed and arranged so that when one of the first and second valve members is container activated, liquid flows to the eductor with the slower flow rate and when the other of the first and second valve members is activated, liquid flows to the other eductor.

In a preferred embodiment, there is a bar member and linkage connecting the bar member to the container activated valve and a valve activating member connected to the other of the first and second valve members, wherein the valve activating member includes a trigger and cable member.

In another preferred embodiment, the multi-port valve is operated by a single selector member.

In one aspect, one of the first and second eductors has a flow rate of 1.0 to 1.7 gpm to provide a slow flow and the other eductor has a flow rate of 3.0 to 4.0 gpm to provide a fast flow rate.

In another aspect, the support member has a multiplicity of pockets to support a plurality of containers.

In still another aspect, there is a drip tray positioned at a bottom of the pocket for a container.

In yet another aspect, the pockets include product identification windows, the pockets for the containers are housed in door members, and the door members are composed of stainless steel or powder coated mild steel with the doors attached to a molded cabinet.

In another aspect, the multi-station liquid mixing and dispensing apparatus includes a housing at least partially defining a first pocket configured to support a first container, a second pocket configured to support a second container, and a third pocket disposed vertically above at least one of the first pocket and the second pocket. A first door is pivotably coupled to the housing and movable between an opened position in which the first container can be inserted within the first pocket, and a closed position in which the first pocket is substantially closed, a second door is pivotably coupled to the housing and movable from an opened position in which the second container can be inserted within the second pocket, and a closed position in which the second pocket is substantially closed, and a valve is coupled to the housing, the valve operable by a user to select which of the first and second containers from which to dispense chemical concentrate.

In another aspect, a multi-station liquid mixing and dispensing apparatus includes a housing defining a first pocket configured to support a first container, a second pocket configured to support a second container, and a third pocket located vertically above one or both of the first pocket and the second pocket. A door is pivotably coupled to the housing and movable from an opened position and a closed position to selectively enclose at least one of the first pocket and the second pocket, and a valve coupled to the housing, the valve operable by a user to select which of the first and second containers from which to dispense chemical concentrate.

In another aspect, a multi-station liquid mixing and dispensing apparatus includes a housing at least partially defining a first pocket configured to support a first container, a second pocket configured to support a second container, and a third pocket configured to support a third container, the third pocket and one of the first pocket and the second pocket intersected by a vertical plane. A first door is pivotably coupled to the housing and movable from an opened position in which the first container can be inserted within the first pocket, and a closed position in which the first pocket is substantially closed, a second door is pivotably coupled to the housing and movable from an opened position in which the second container can be inserted within the second pocket, and a closed position in which the second pocket is substantially closed, and a valve is coupled to the housing, the valve operable by a user to select which of the first and second containers from which to dispense chemical concentrate.

DESCRIPTION OF THE PREFERRED EMBODIMENT

Figure 1:
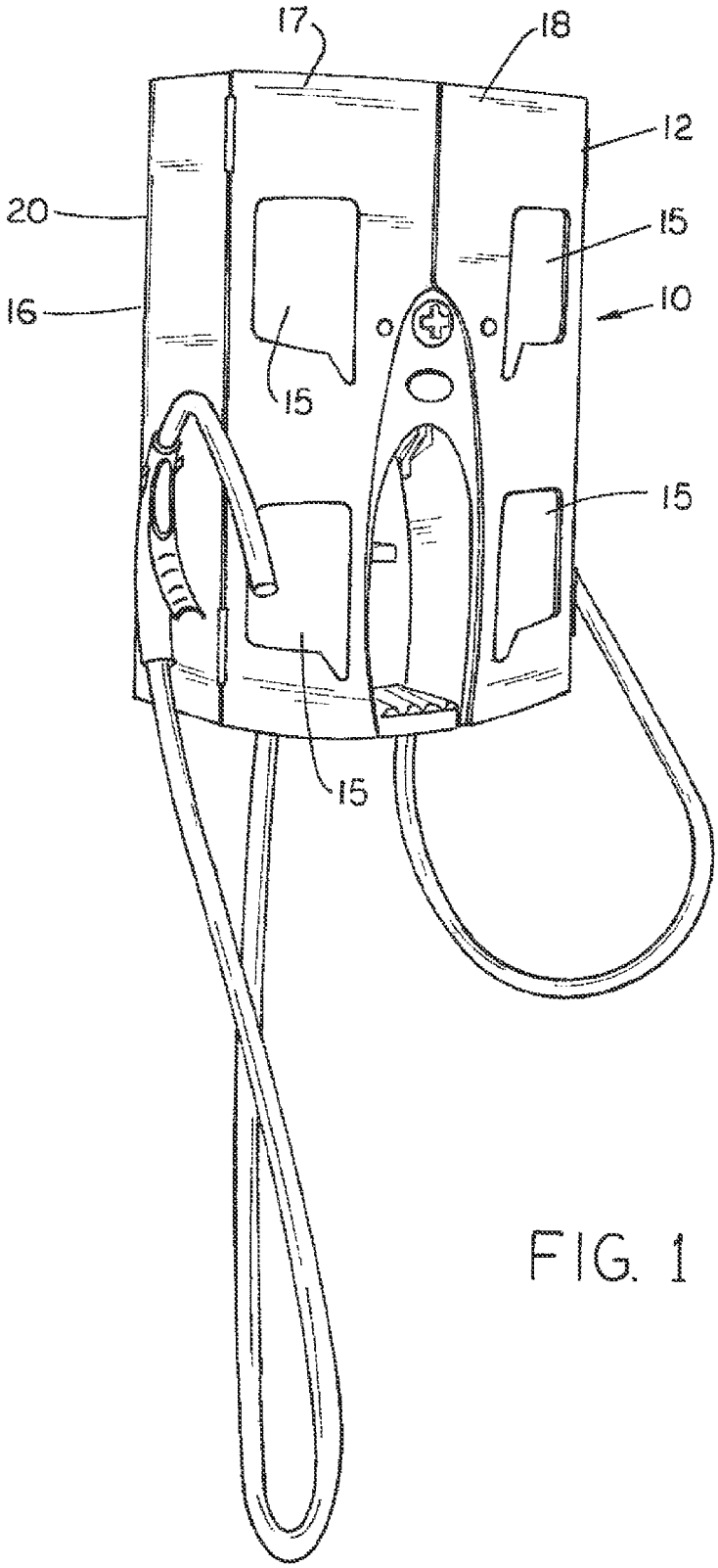
FIG. 1 is a perspective view of the multi-station liquid dispensing apparatus.
Figure 2:
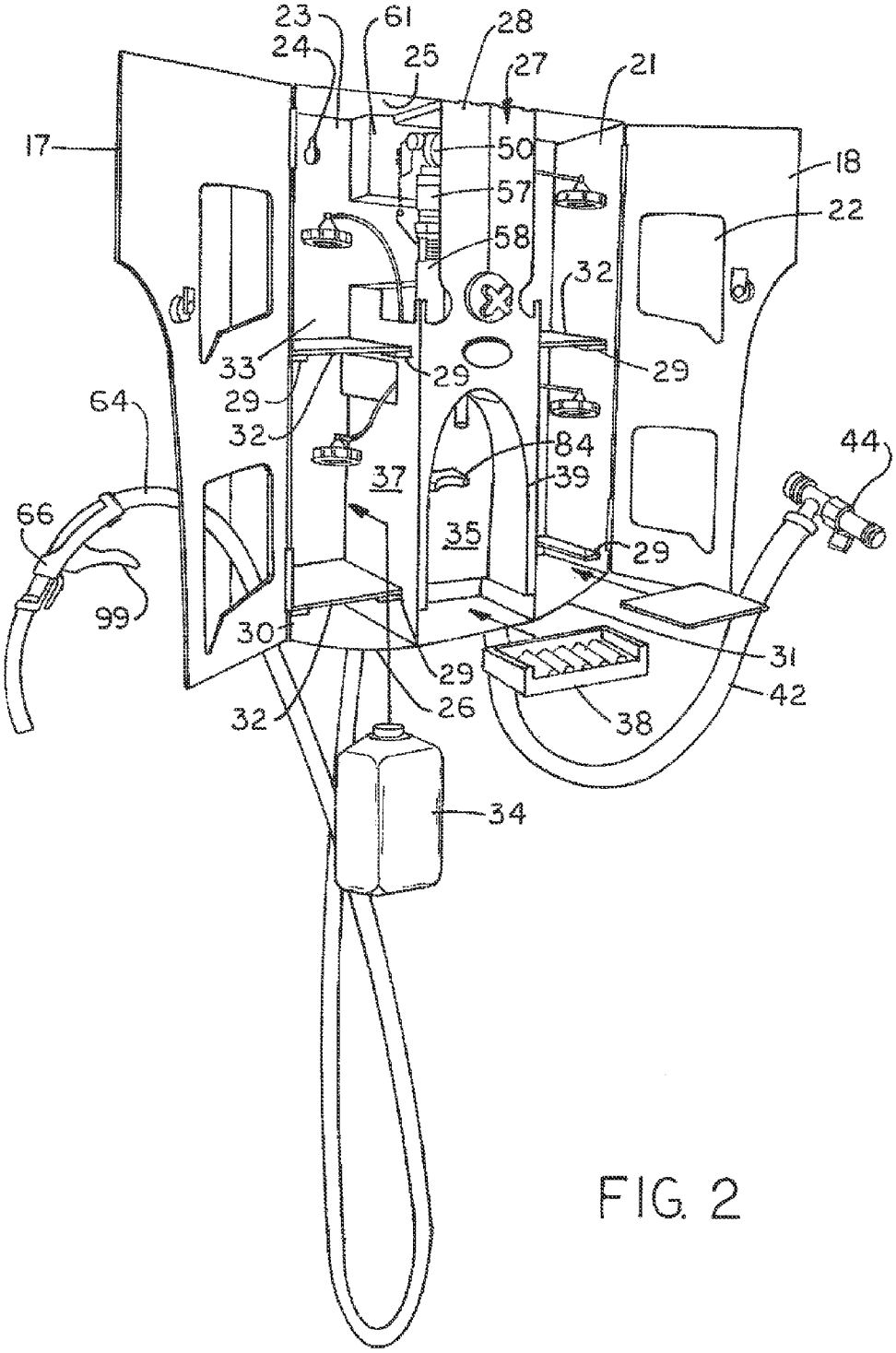
FIG. 2 is a view similar to FIG. 1 showing the doors of the cabinet of the apparatus in an open condition for viewing the inside thereof.
Figure 3:
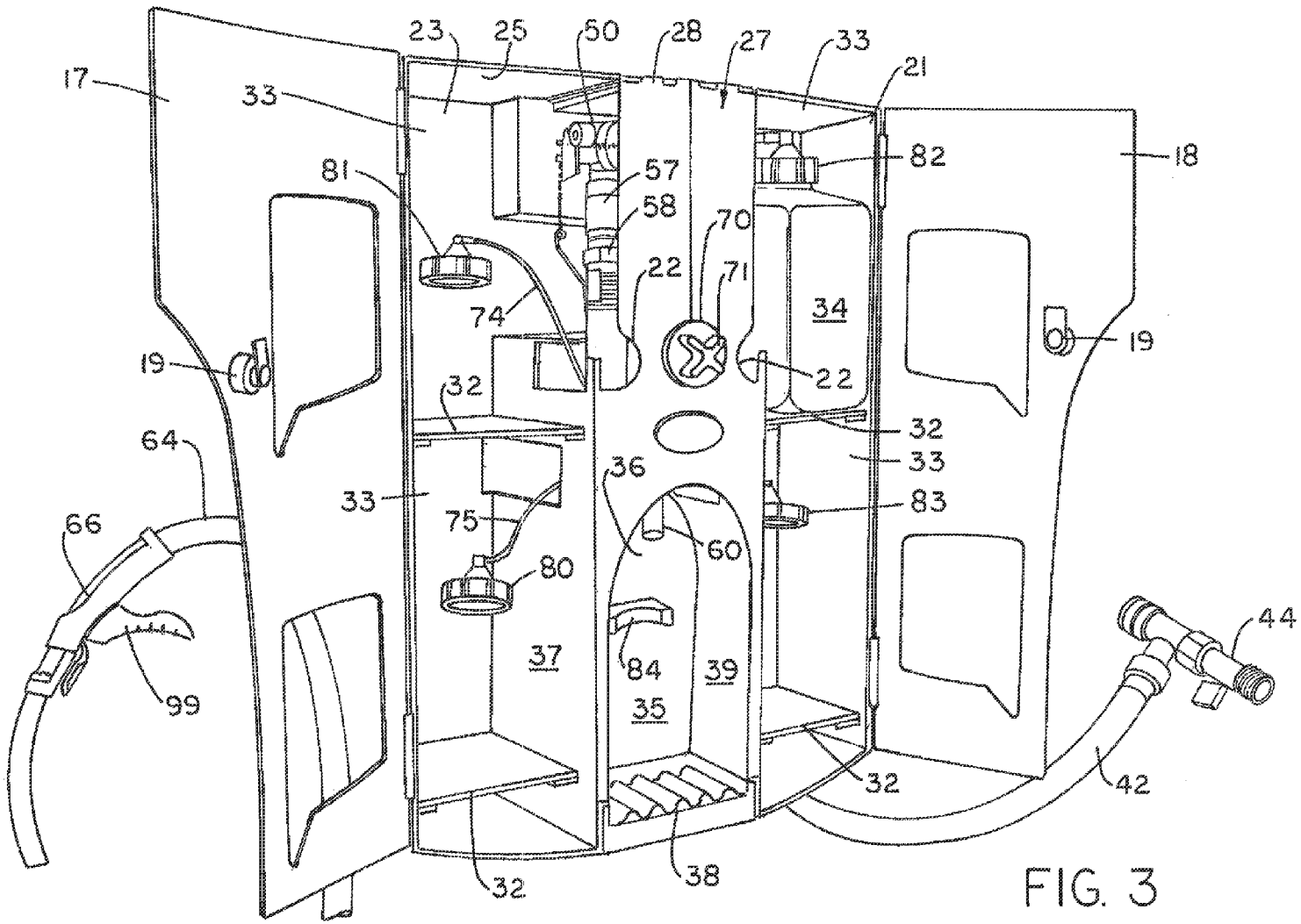
FIG. 3 is an enlarged view of the cabinet similar to FIG. 2.

Referring to FIGS. 1-3, the mixing and dispensing apparatus generally 10 includes a cabinet member 12 which provides a housing 16 composed of two hinged doors 17 and 18 connected to side panels 20 and 21, respectively. The housing also includes a rear wall 23 and a top wall 25. There are slots such as 24 in the rear wall 23 to afford connection to a wall by means of screws or bolts. There is also a central section generally 27 formed with walls 37 and 39. There are flanges 29 and 30 extending from walls 37 and 39 as well as from side panels 16 and 21 to provide a support for plates 32. These plates 32 inside cabinet 12 provide pockets 33 for supporting containers such as 34 for liquid chemical concentrate. Bottom panels 26 and 31 connect side walls 37 and 39 with side panels 20 and 21, respectively. There is also a hinged panel 28 connected to top wall 25.

Figure 4:
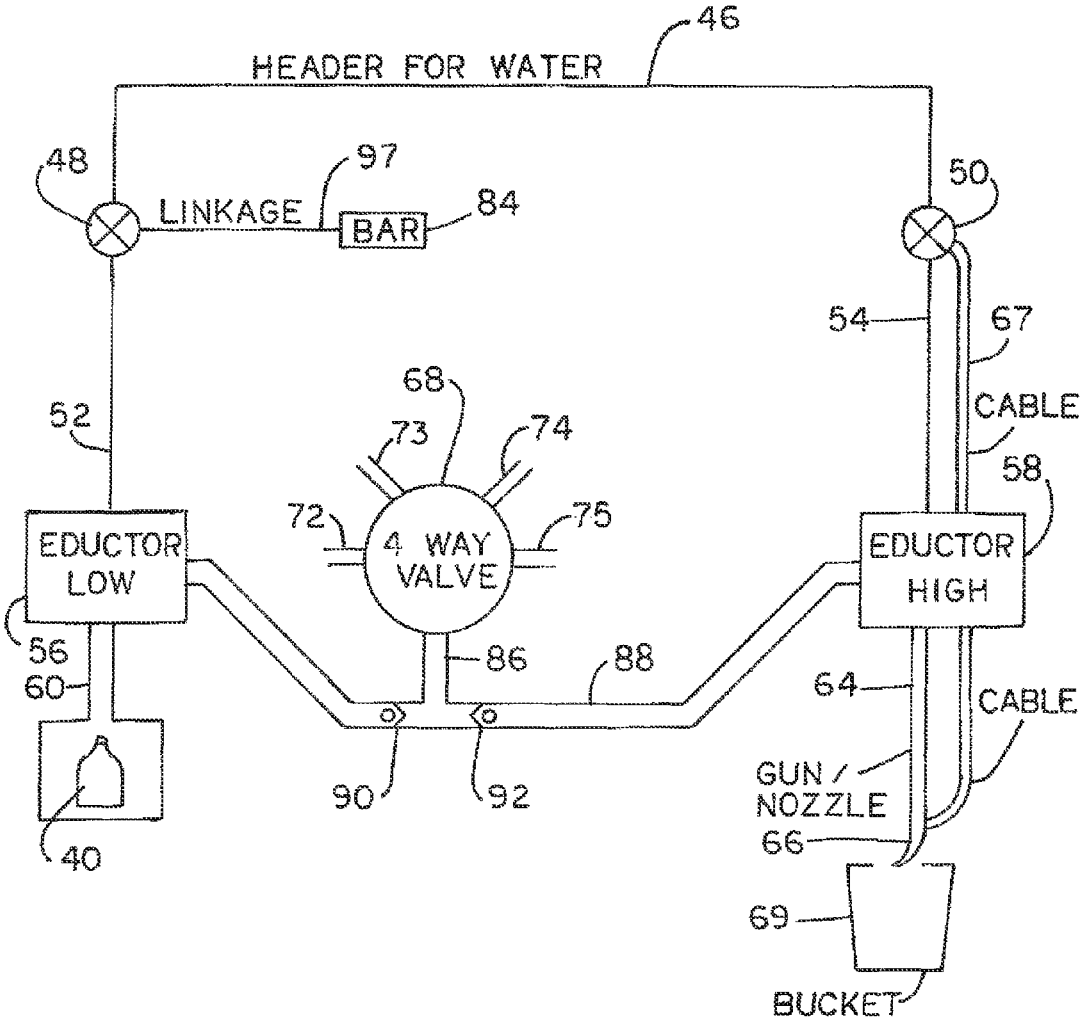
FIG. 4 is a diagrammatic view illustrating the supply and control system for the dispensing apparatus.

There is an additional alcove-like pocket 36 in central section 27 with a drip tray 38 which is slideably supported and positioned at the bottom thereof. It affords support for a liquid container 40 as shown in FIG. 4. Alcove pocket is provided by back wall 35 and side walls 37 and 39.

Referring to FIGS. 2, 3 and 4, there is a water supply hose 42 with a filter valve 44 for supplying water to the header 46 in the customary manner. There are two valves 48 and 50 connected to the header 46. Water supply line 52 supplies water to a low flow rate eductor 56 whereas water supply line 54 supplies high flow rate to eductor 58. The preferred eductors 56 and 58 are those described in commonly owned U.S. patent application Ser. No. 11/195,052 filed Aug. 2, 2005, which teachings are incorporated herein by reference. An outlet line 60 conveys product from eductor 56 to container 40. Similarly hose outlet line 64 and gun/nozzle 66 convey product to bucket 69. The gun of gun/nozzle 66 is connected to cable 67 which is also connected to valve 50. Gun nozzle 66 as well as valve 50, are described in U.S. Pat. No. 6,299,035, which teachings are incorporated herein by reference.

A four-way valve 68 is connected to eductors 56 and 58 and positioned inside central section 27. It is controlled by knob 70. There are four product inlet lines 72, 73, 74 and 75 connected to the four-way valve 68 as well as to container caps 80, 81, 82 and 83, respectively. The preferred four-way valve 68 is described in commonly assigned U.S. Patent Application Ser. No. 60/707,399 filed Aug. 11, 2005, which teachings are incorporated herein by reference. There is an outlet line 86 interconnected with common line 88 as well as eductors 56 and 58. Two check valves 90 and 92 are positioned in line 88, for purposes as will be explained later in the Operation.

Figure 5:
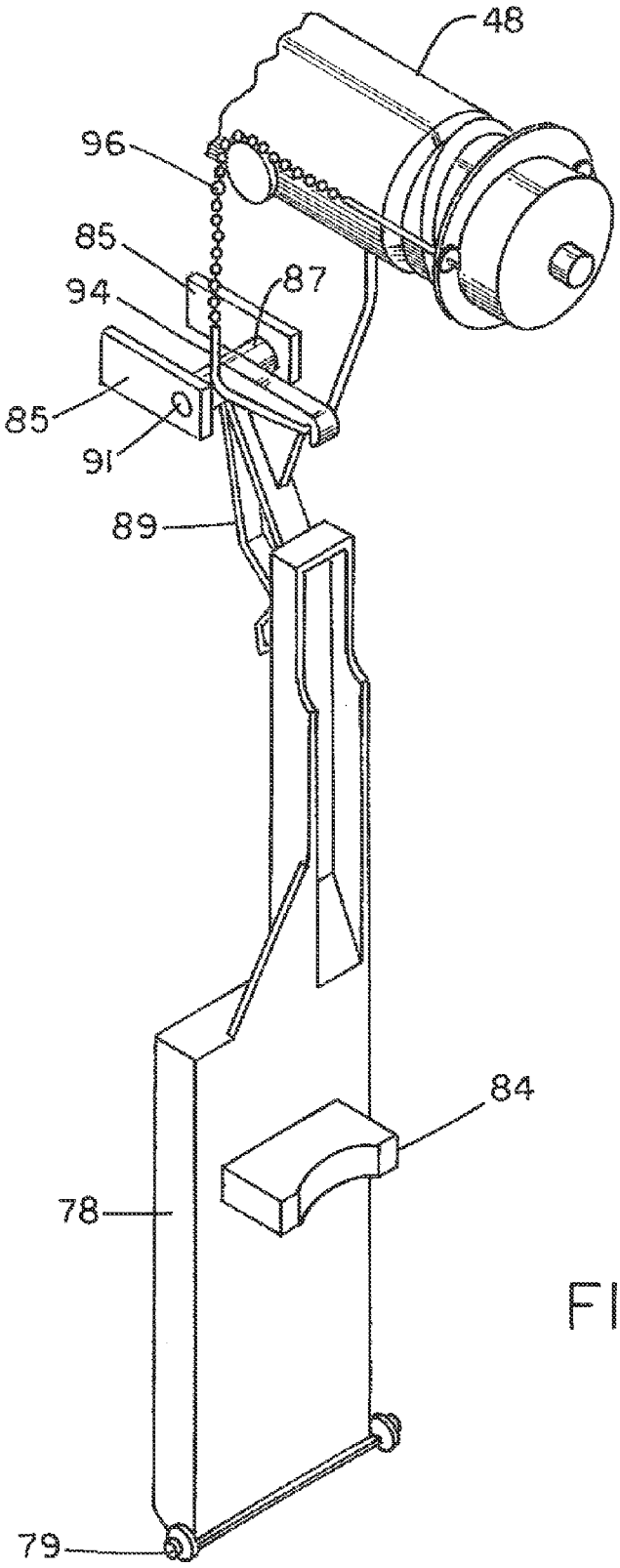
FIG. 5 is a perspective view of the linkage for activating one of the valves.
Figure 6:
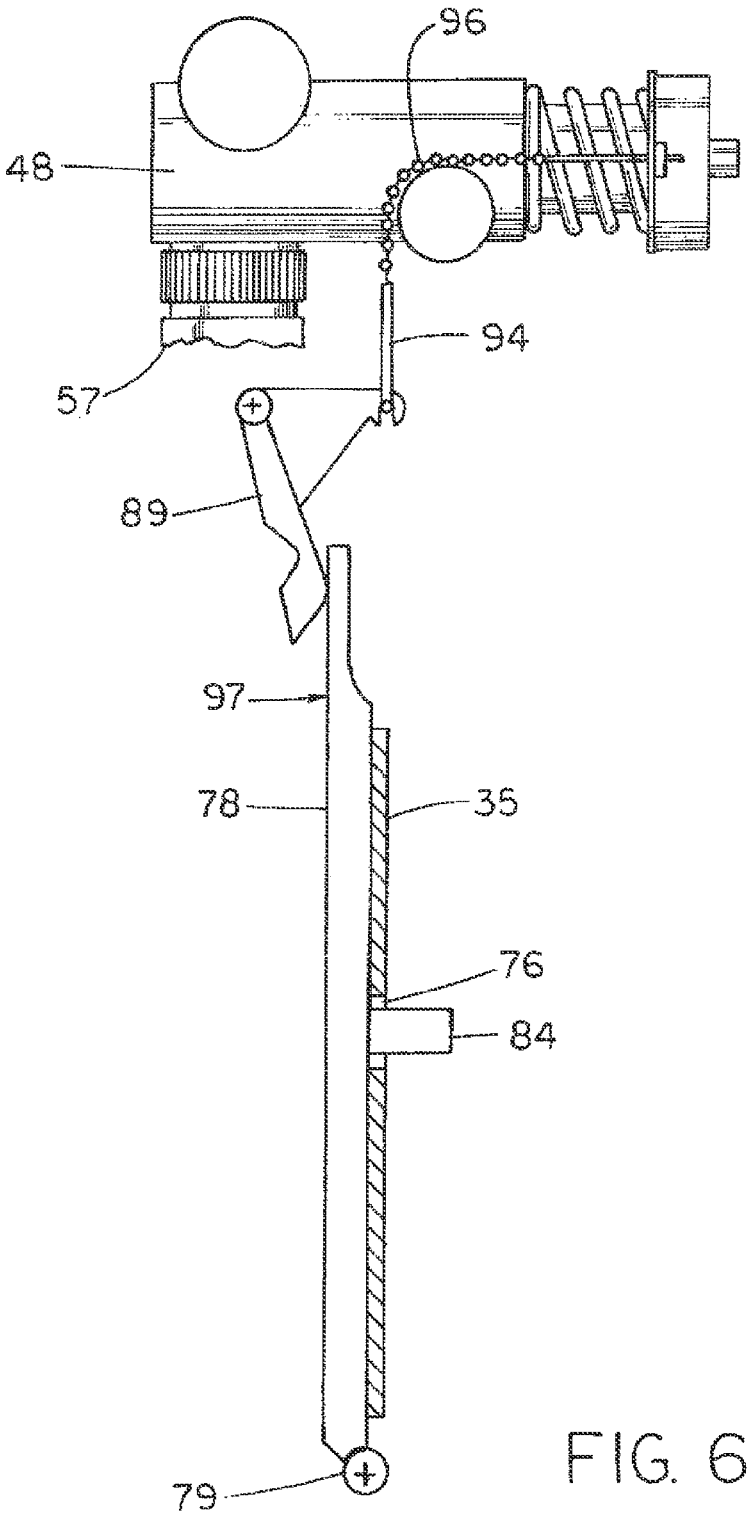
FIG. 6 is a side view of the linkage shown in FIG. 5 illustrating the linkage in a non-operative condition.
Figure 7:
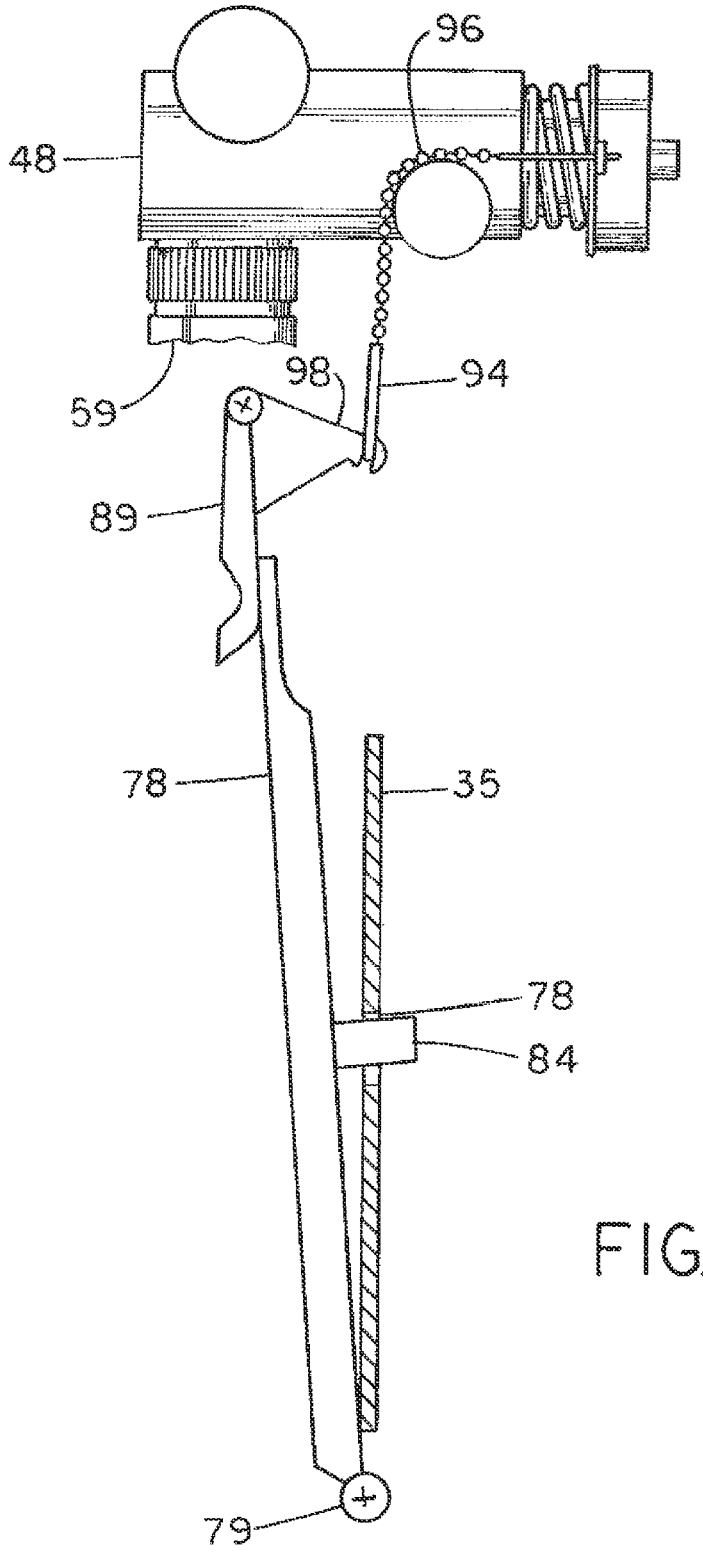
FIG. 7 is a view similar to FIG. 6 showing the linkage in an operative condition.

As seen in FIGS. 5, 6 and 7, a bottle contact bar 84 extends through opening 76 in alcove back wall 35. Bar 84 extends from arm 78 pivotally connected at 79 to flanges (not shown) extending from the bottom of alcove side walls 37 and 39. Arm 78 contacts crank portion 89 pivotally attached at 91 by trunion 87 to flanges 85 connected to rear wall 23 (see FIG. 3). Yoke 94 connects pull chain 96 to valve 48 in the manner described in U.S. Pat. No. 6,299,035. The previously described components comprise the linkage 97 for actuating valve 48.

Operation

A better understanding of the dispensing apparatus will be had by a description of its operation. Referring to FIG. 3, containers with chemical concentrate such as shown at 34 are placed in pockets such as 33 in cabinet 12 and connected to caps 80, 81, 82 and 83. Each container will preferably contain a different chemical concentrate. Doors 17 and 18 are closed and latched such as by latches 19 engaging cut outs 22 in central support section 27. Filter valve 44 is connected to a source of pressurized water which causes water to flow to header as seen in FIG. 4. The operator then selects which of the chemical concentrates is to be diluted and educted by means of knob 70 and pointer 71.

The pointer 71 of a knob 70 is directed toward which container in which pocket 33 is to be activated by means of the four way valve 68. The operator then determines whether a bottle 40 is to be filled with the diluted chemical concentrate or a bucket 69.

If a bottle 40 is to be filled, it is placed in alcove pocket 36. Placement of bottle 40 therein presses against bar 84 which by means of linkage 97 activates valve 48 as shown in FIG. 7. Activation is effected by arm 78 moving away from wall 35 which causes arm 98 of crank portion 89 to move downwardly. This exerts a pulling effect on connector 94 and chain 96 to open valve 48. This causes pressurized water to flow into low flow rate eductor 56. At the same time, reduced pressure is effected in lines 88 and 86 as well as one of the conduit lines 72-75 depending upon which is selected by the operator by means of the four-way valve 68. In this instance check valve 90 opens whereas check valve 92 closes so there is no siphoning effect beyond line 86 and eductor 58. Diluted chemical concentrate flows through outlet line 60 into bottle 40. Once bottle 40 is filled with diluted concentrate, it is removed from the alcove pocket 36 which releases the force on bar 84 and closes valve 48. This is shown in FIG. 6.

If a bucket 69 is to be filled with diluted chemical concentrate, gun nozzle 66 is activated by pressing lever 99 (see FIG. 3). This creates a pulling force on cable 67 to activate valve 50 which causes pressurized water to flow into high flow rate eductor 58. A siphoning action is effected in outlet lines 88 and 86 with an opening of check valve 92 and a closing of check valve 90. This in turn draws chemical concentrate from one of the conduit lines 72-75 and accordingly the selected container 34. When the lever is released, valve 50 closes and the previously described siphoning action ceases.

It will thus be seen that there is now provided a mixing and dispensing apparatus which affords ease of dispensing. Once the selector knob 70 is moved to a position to select the desired chemical concentrate, all that is required to activate the dispenser 10 is to place a bottle 40 in alcove 36 and against bar 84. This is accomplished with one hand. The same advantages pertain to filling bucket 69. All that is required is a selection of the desired concentrate by means of selector knob 70 and four-way valve 68, and a pressing of lever 99 of gun nozzle 66. This also affords remote bucket filling.

Other important features of the dispenser 10 are latches 19 which are key locks and afford a locking of the doors 17 and 18. This is seen in FIG. 3. The doors 17 and 18 are composed of stainless steel or powder coated mild steel whereas the cabinet is composed of durable molded ABS plastic. This affords a reduced maintenance dispenser. Product identification is easily made through windows 15.

The cabinet 12 affords on-wall repair, compatibility with multiple packages, in field retrofit as well as quick connect of serviceable components and improved ergonomics. Hinged panel 28 provides ready access to the eductors 56 and 58 which are connected to panel 61. Eductors 56 and 58 are connected to valves 48 and 50 by a Gardena connector 57 such as illustrated in FIG. 3. This provides ease of connection or disconnection. If desired, a battery powered indicator light could be employed in conjunction with knob 70 and pockets 33 to indicate which chemical concentrate is selected for dispensing.

Particular magnetic, pull-chain operated valves 48 and 50 are employed in conjunction with linkage 97 and gun/nozzle 66. Any valve which can be linkage or cable operated could be substituted. While eductors 56 and 58 are of the non-air gap type, depending on plumbing codes, air gap eductors can be employed such as that described in U.S. Pat. No. 5,927,338 and U.S. Pat. No. 6,279,598. A four-way valve 68 is described for use in conjunction with dispenser 10. If desired, a valve with any number of product inlet lines could be used depending on the size of the cabinet 12. All such and other modifications within the spirit of the invention are meant to be within its scope, as defined by the appended claims.

What is claimed is:

1. A multi-station liquid mixing and dispensing apparatus comprising:

a housing at least partially defining a first pocket configured to support a first container, and a second pocket configured to support a second container;

at least one door pivotably coupled to the housing and movable to enclose one or both of the first pocket and the second pocket;

a first eductor disposed in the housing and in fluid communication with the first container and the second container to selectively draw chemical concentrate from the first container or the second container;

a second eductor disposed in the housing and in fluid communication with the first container and the second container to selectively draw chemical concentrate from the first container or the second container; and a valve assembly coupled to the housing and in fluid communication with the first eductor and the second eductor, the valve assembly operable by a user to select either the first container or the second container from which to dispense chemical concentrate via one of the first and second eductors.

2. The multi-station liquid mixing and dispensing apparatus of claim 1, wherein the at least one door is a first door and the apparatus includes a second door, and wherein the housing further includes a central support section located between the first door and the second door, and a latch to secure the first door in the closed position of the first door.

3. The multi-station liquid mixing and dispensing apparatus of claim 1, further comprising:

an additional pocket at least partially defined by the housing and configured to receive a third container; and a fluid line extending to the additional pocket for fluid dispense into the third container, the fluid line receiving fluid including chemical concentrate from the first container or the second container.

4. The multi-station liquid mixing and dispensing apparatus of claim 1, further comprising a hinged panel providing access to the eductor.

5. The multi-station liquid mixing and dispensing apparatus of claim 1, wherein the valve assembly is operable by a user-manipulatable control having an indicator, the indicator movable by movement of the user-manipulatable control to different positions each pointing generally toward the container from which chemical concentrate is dispensed in the corresponding position of the valve assembly.

6. The multi-station liquid mixing and dispensing apparatus of claim 1, wherein the housing has a bottom panel at least partially defined by an outwardly curved profile, and wherein the at least one door is curved to substantially match the outwardly curved profile of the bottom panel.

7. The multi-station liquid mixing and dispensing apparatus of claim 6, wherein the at least one door includes a first window and a second window, and wherein the first window is positioned and dimensioned to permit user identification of the first container in the housing and the level of liquid in the first container, and the second window is positioned and dimensioned to permit user identification of the second container in the housing and the level of liquid in the second container.

8. A multi-station liquid mixing and dispensing apparatus comprising:

a housing defining a first pocket configured to support a first container, a second pocket configured to support a second container, and a third pocket disposed laterally relative to the first pocket and the second pocket, the first and second containers each defining a source of chemical concentrate;

a first eductor disposed in the housing and in fluid communication with the first container and the second container to selectively draw chemical concentrate from the first container or the second container, the first eductor having a first outlet extending into the third pocket; and a second eductor disposed in the housing and in fluid communication with the first container and the second container to selectively draw chemical concentrate from the first container or the second container, the second eductor having a second outlet; and a valve assembly coupled to the housing and fluidly coupled to both the first eductor and the second eductor to select the source of chemical concentrate for each of the first eductor and the second eductor.

9. The multi-station liquid mixing and dispensing apparatus of claim 8, wherein the housing further includes a central support section located between the first pocket and the second pocket, and wherein the third pocket defines an alcove in the central support section and is configured to support a liquid container to be filled via the first outlet.

10. The multi-station liquid mixing and dispensing apparatus of claim 8, further comprising a hinged panel providing access to the eductor.

11. The multi-station liquid mixing and dispensing apparatus of claim 8, wherein the valve assembly is operable by a user-manipulatable control to select the first container or the second container from which chemical concentrate is dispensed.

12. A multi-station liquid mixing and dispensing apparatus comprising:

a housing defining a first pocket configured to support a first container, a second pocket configured to support a second container, and a third pocket configured to support a third container, the first and second containers each defining a source of chemical concentrate;

a first door pivotably coupled to the housing and movable from an opened position in which the first container can be inserted within the first pocket, and a closed position in which the first pocket is substantially closed;

a second door pivotably coupled to the housing and movable from an opened position in which the second container can be inserted within the second pocket, and a closed position in which the second pocket is substantially closed;

a first eductor disposed in the housing and in fluid communication with the first container and the second container to selectively draw chemical concentrate from the first container or the second container;

a second eductor disposed in the housing and in fluid communication with the first container and the second container to selectively draw chemical concentrate from the first container or the second container; and a valve assembly coupled to the housing and fluidly coupled to both the first eductor and the second eductor to select the source of chemical concentrate for each of the first eductor and the second eductor, wherein the housing defines an alcove pocket located between the first pocket and the second pocket or the third pocket, the alcove pocket configured to support a fluid container, and wherein an actuator is disposed within the alcove pocket and actuatable to dispense fluid including chemical concentrate into the fluid container.

13. The multi-station liquid mixing and dispensing apparatus of claim 12, wherein:

the housing has a bottom panel at least partially defined by an outwardly curved profile; and each of the first door and the second door is curved to substantially match the outwardly curved profile of the bottom panel.

14. The multi-station liquid mixing and dispensing apparatus of claim 1, wherein the first eductor has a first flow rate and the second eductor has a second flow rate that is faster than the first flow rate.

15. The multi-station liquid mixing and dispensing apparatus of claim 8, wherein the first eductor has a first flow rate and the second eductor has a second flow rate that is faster than the first flow rate.

16. The multi-station liquid mixing and dispensing apparatus of claim 8, further comprising separate diluent supply lines fluidly coupled to the first eductor and the second eductor, respectively, and wherein each water supply line has a diluent valve to control the flow of diluent to the respective first and second eductors.

17. The multi-station liquid mixing and dispensing apparatus of claim 8, wherein the second outlet is located exterior of the housing.

18. The multi-station liquid mixing and dispensing apparatus of claim 12, wherein the first door includes a first window through which the first container can be identified, and wherein the second door includes a second window through which the second container can be identified.

19. The multi-station liquid mixing and dispensing apparatus of claim 18, wherein the first window and the second window are positioned and dimensioned to permit user identification of the level of liquid in the first and second containers, respectively.

20. The multi-station liquid mixing and dispensing apparatus of claim 12, wherein the first eductor has a first flow rate and the second eductor has a second flow rate that is faster than the first flow rate.

* * * * *